US006273766B1

(12) United States Patent
Zennamo, Jr. et al.

(10) Patent No.: US 6,273,766 B1
(45) Date of Patent: Aug. 14, 2001

(54) ELECTRONIC DEVICE INCLUDING A COLLET ASSEMBLY WITH DUAL RECEIVING SOCKETS

(75) Inventors: Joseph A. Zennamo, Jr., Skaneateles; Joseph N. Maguire, Syracuse, both of NY (US)

(73) Assignee: Eagle Comtronics, Inc., Clay, NY (US)

( * ) Notice: Subject to any disclaimer, the term of this patent is extended or adjusted under 35 U.S.C. 154(b) by 0 days.

(21) Appl. No.: 09/658,206

(22) Filed: Sep. 8, 2000

(51) Int. Cl.[7] ..... H01R 13/187
(52) U.S. Cl. ..... 439/843
(58) Field of Search ..... 439/843, 441, 439/439, 891, 76.1

(56) References Cited

U.S. PATENT DOCUMENTS 4,669,805 * 6/1987 Kosugi et al. ..... 439/581
5,484,306 * 1/1996 Mawby et al. ..... 439/441
5,601,457 * 2/1997 Le Gall ..... 439/843
5,662,494 * 9/1997 Zennamo, Jr. et al. ..... 439/589

* cited by examiner

*Primary Examiner*—Brian Sircus
*Assistant Examiner*—Phuong K T Dinh
(74) *Attorney, Agent, or Firm*—Burr & Brown

(57) ABSTRACT

An electronic device of the type including a threaded female connector adapted to mate with a cable connector including a housing, a female connector extending from the housing, and a circuit board positioned within said housing and having a first presoldered conductor wire extending therefrom toward the female connector. The electronic device further includes a collet assembly positioned within a bore of the threaded female connector, wherein the collet assembly comprises a generally cylindrical insulating body having a first end and an opposed second end, an electrically conductive collet contact passing through the insulating body and having a first end proximate the first end of the insulating body and a second end proximate the second end of the insulating body. The first end of the collet contact includes a first gripping member for gripping an external conductor wire introduced into the female connector bore, and the second end of the collet contact includes a second gripping member for gripping the first presoldered conductor wire.

15 Claims, 4 Drawing Sheets

ELECTRONIC DEVICE INCLUDING A COLLET ASSEMBLY WITH DUAL RECEIVING SOCKETS

FIELD OF THE INVENTION

The present invention relates to an electronic device, including a collet assembly having an improved mechanical connection mechanism for receiving electrical conductor wires.

BACKGROUND OF THE INVENTION

The manufacture of electronic devices such as electronic filters, involves mass production assembly of a number of separate components. An example of such an electronic filter is disclosed in U.S. Pat. No. 5,662,494, the entirety of which is incorporated by reference herein. The '494 filter housing 1 shown in FIG. 1 includes a female connector bore 2, a pre-assembled collet assembly 3 positioned within the bore and having collet contact 4 extending from the collet assembly. The collet contact is secured to a circuit board 5 having discrete electronic components 6A–6D. A conductor wire 7 is secured to the circuit board and extends from the circuit board through a male connector end 8 of the housing.

The filter is assembled using a multi-step process, comprising both efficient and inefficient assembly techniques. The discrete electronic components 6A–6D and the conductor wire 7 are wave soldered to the circuit board 5 contemporaneously in their respective positions. This portion of the manufacturing process is highly efficient, as it is fully automated.

In order to complete the circuit board assembly of FIG. 1, the collet contact 4, which is an integral part of the collet assembly, must also be soldered to the circuit board. The collet assembly 3 is a prefabricated unit from which the integrated collet contact 4 extends. Securing the collet contact 4 to the circuit board 5 requires a separate, hand-soldering step, because the heat generated during wave soldering would melt the plastic components of the collet assembly. This step is both inefficient and costly.

Although the overall structure of the filter in FIG. 1 is relatively simple and inexpensive to manufacture and assemble, the requisite hand-soldering step to secure the collet contact to the circuit board creates an additional, inefficient manual step. The need for such an extra, manual manufacturing step limits the speed and efficiency of the process technique, and increases the costs associated with the manufacture of electronic devices of this nature.

It would be desirable to provide an electronic device with a collet assembly to be mated with a circuit board which does not necessitate the extra, inefficient manual step required in the conventional manufacturing technique described above. It would also be desirable to increase production speed and efficiency, and decrease overall production costs by achieving more efficient automated assembly of the circuit board.

SUMMARY OF THE INVENTION

It is an object of the present invention to overcome the drawbacks of the prior art, particularly to provide an electronic device having a collet assembly that can be secured to a circuit board without a separate, manual soldering step during assembly of the electronic device.

In accordance with a first embodiment of the present invention, an electronic device of the type including a threaded female connector adapted to mate with a cable connector is provided that includes a housing and a female connector bore extending from the housing. The filter also includes a circuit board which is positioned within the housing and has a first presoldered conductor wire extending therefrom toward the female connector bore.

The device of this preferred embodiment further includes a collet assembly which is positioned within the female connector bore and includes a generally cylindrical insulating body extending along a longitudinal direction from a first end thereof to an opposed second end thereof. The collet assembly also includes a collet contact which passes through the insulating body, and has a first end proximate to the first end of the insulating body and a second end proximate to the second end of the insulating body. The collet assembly further includes a first gripping member for gripping an external conductor wire introduced into the female connector bore, and a second gripping member for gripping a first presoldered conductor wire extending from the first end of the circuit board.

Since the second female socket receives the first presoldered conductor wire that extends from the circuit board, the first presoldered conductor wire can be wave soldered onto the circuit board along with the discrete electronic components and the second conductor wire in an automated manufacturing step. The first presoldered conductor wire can then be mechanically inserted into the second female socket of the collet contact. This eliminates the need for a separate hand-soldering step in the assembly of the electronic device.

In accordance with a preferred embodiment of the present invention, the first gripping member of the collet assembly is defined by a first female socket secured within the first end of the collet contact. More preferably, the first female socket comprises a band member having contact fingers extending therefrom in a longitudinal direction of the collet contact. The second gripping member is also preferably a second female socket secured within the second end of the collet contact. More preferably, the second female socket comprises a band member having contact fingers extending therefrom in a longitudinal direction of the collet contact.

As an alternative, one or both gripping members could be formed integrally with he collet contact in the form of an axially split and radially compressed bore.

In accordance with another preferred embodiment of the present invention, the insulating body of the collet assembly includes a front insulator having inner and outer surfaces, and a rear insulator having inner and outer surfaces. More preferably, the rear insulator of the collet assembly further includes a first section having a first diameter, and a second section having a second diameter, wherein a portion of the first section of the rear insulator extends within the front insulator.

It is also preferred that the front insulator of the collet assembly has a cylindrical sidewall having inner and outer surfaces and an end wall substantially enclosing one end of the front insulator, wherein the portion of the first section of the rear insulator is surrounded by the sidewall of the front insulator. More preferably, the front insulator further includes a plurality of longitudinally extending ridges on the inner surface of the sidewall providing contact with the first section of the rear insulator.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 2:
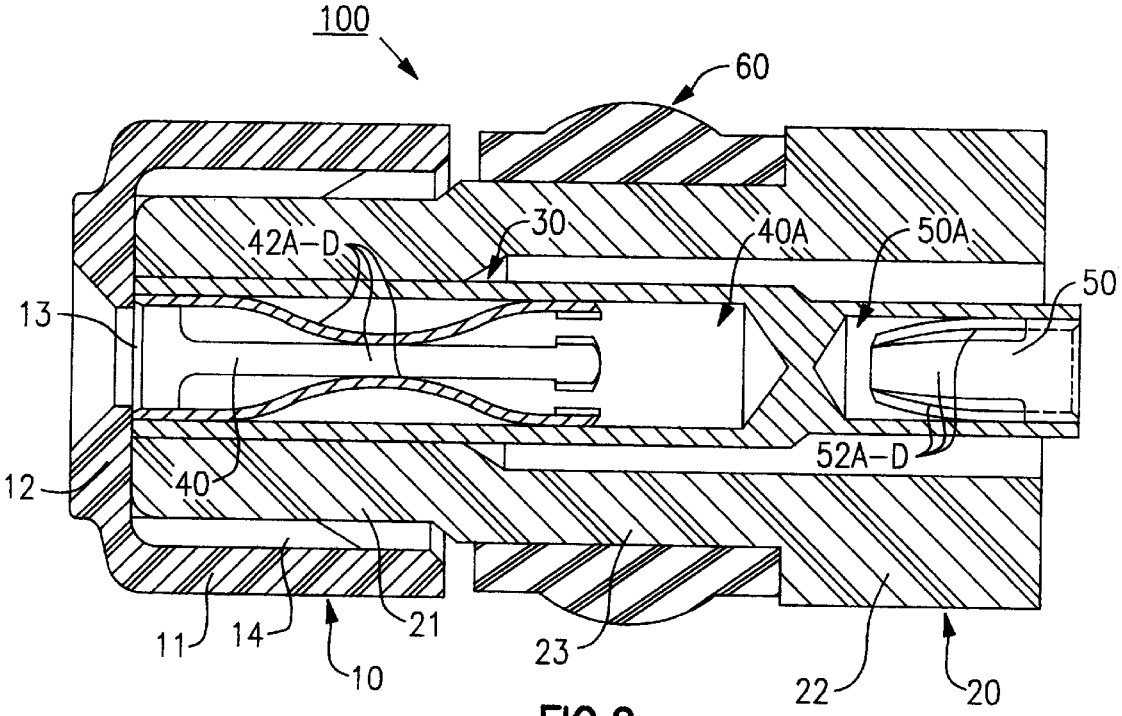
FIG. 2 is a cross sectional view of a collet assembly in accordance with one embodiment of the present invention.

FIG. 2 is a cross sectional view of a collet assembly 100 in accordance with one embodiment of the present invention. The collet assembly 100 includes a front insulator 10 having a generally cylindrical sidewall 11 and an end wall 12 substantially enclosing one end of the front insulator 10. The end wall 12 includes a guide hole 13 through which a center conductor of a cable may be introduced into the collet assembly. The collet assembly 100 also includes a rear insulator 20, which is generally cylindrical in shape having a first section 21 having a first diameter, a second section 22 having a second diameter, and a third section 23 having a third diameter. The first section 21 of the rear insulator 20 is surrounded by the front insulator 10 and is in contact with inner ridges 14 extending longitudinally along the inner surface of sidewall 11 of the front insulator 10. The second section 22 of the rear insulator 20 is proximate to the second end of the collet contact 30. The third section 23 of the rear insulator 20 is positioned between the first section 21 and the second section 22.The front insulator 10 is made from an electrically insulating material, one example of which is polypropylene. The rear insulator 20 is also made from an insulating material, one example of which is polypropylene.

An elastomer seal 60 is seated on the outer surface of the rear insulator 20 at the third section 23 and forms a surface compression seal as described in commonly owned U.S. Pat. No. 5,662,494 incorporated by reference herein. The elastomer seal 60 is made from an elastomer material, one example of which is rubber.

The collet assembly 100 also includes a collet contact 30 extending longitudinally from the front insulator 10 toward the rear insulator 20. The collet contact 30 is made from an electrically conductive material, one example of which is brass.

A first female socket 40 is press fit within the collet contact 30 proximate to the front insulator 10 and extends longitudinally toward the rear insulator 20. The first female socket 40 comprises a generally circular band member 45 (FIG. 4A) from which a plurality of contact fingers 42A–D extend cylindrically and longitudinally within collet contact 30. The contact fingers 42A–D are bent inward to provide an elongated surface for contact with a conductor wire to be received therein, and to provide two points of contact between the contact fingers 42A–D and the collet contact 30. The contact fingers 42A–D of the first female socket 40 are made from an electrically conductive material, one example of which is beryllium copper.

A second female socket 50 is press fit within the collet contact 30 proximate to the end of the rear insulator 20 and extends longitudinally toward the front insulator 10. The second female socket 50 comprises a generally circular band member 55 (FIG. 5A) from which a plurality of contact fingers 52A–D extend cylindrically and longitudinally within collet contact 30. The contact fingers 52A–D of the second female socket 50 are bent to taper inwardly along the length of the fingers to provide an elongated surface for contact with a conductor wire to be introduced therein. The contact fingers 52A–D of the second female socket 50 are made from an electrically conductive material, an example of which is phosphor bronze.

Figure 1:
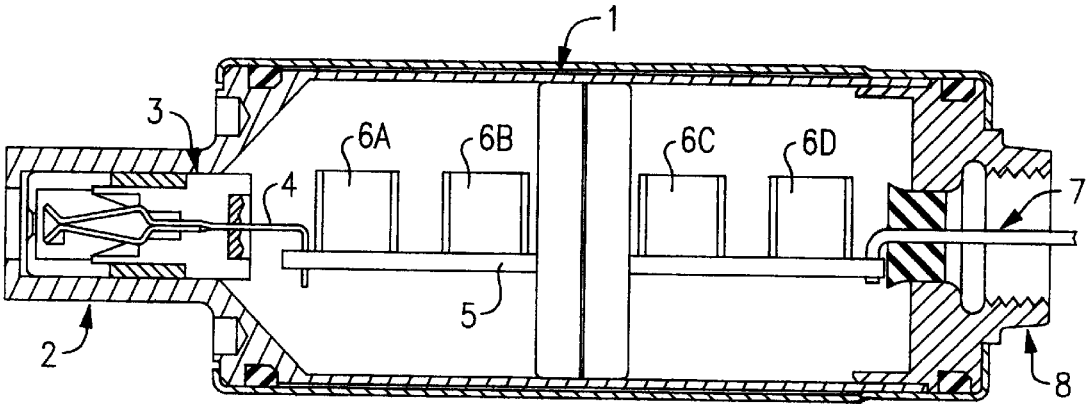
FIG.1 Prior Art
FIG. 1 is a cross sectional view of a prior art filter.

The collet assembly 100 of the present invention may be appreciated in conjunction with the prior art filter of the '494 patent shown in FIG. 1. Because of the placement of the second female socket 50, the overall length of the collet assembly 100 may be longer than the collet assembly 3 in FIG. 1. To accommodate the longer collet assembly 100, the female connector bore 2 of the filter housing 1 may be longer as well. The increased length of the female connector bore 2 also accommodates placement of an integral fastening device on the outside surface of the connector bore 2 as shown and described in co-pending U.S. patent application Ser. No. 09/641,989, entitled Electrical Signal Filter Housing With Hexagonal Drive Section, filed Aug. 18, 2000.

Figure 3:
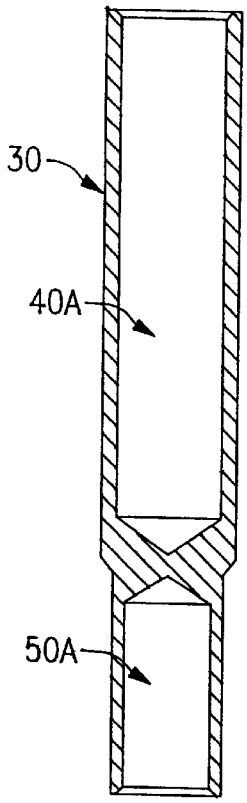
FIG. 3 is a cross sectional view of the collet contact of FIG. 2 before the first and second female sockets are press fit therein.

FIG. 3 is a cross sectional view of the collet contact 30 of FIG. 2 before the first female socket 40 and the second female socket 50 are press fit therein. A first bore 40A is provided for receiving the first female socket 40. A second bore 50A is provided for receiving the second female socket 50.

Figure 4A:
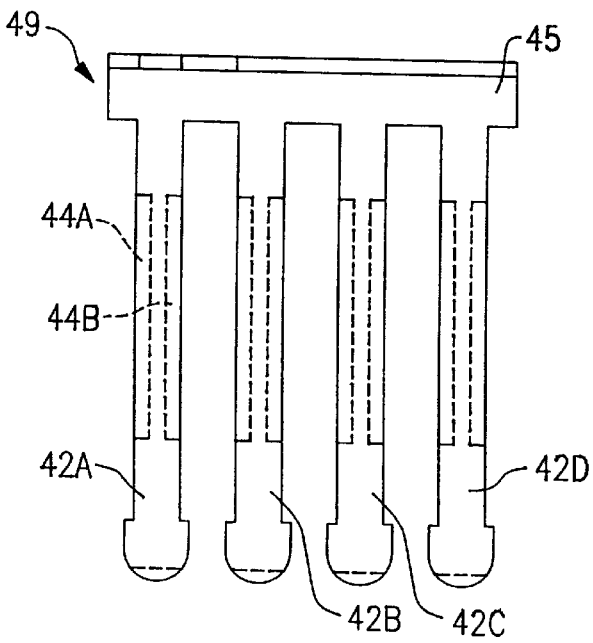
FIG. 4A is a view showing the stamped band member and contact fingers before rolling to form the cylindrical configuration of the first female socket as depicted in FIG. 2.
Figure 4B:
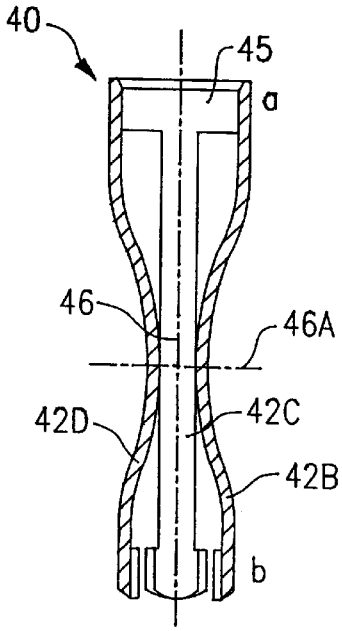
FIG. 4B is a view of the band member and contact fingers of the first female socket after rolling to form a generally cylindrical configuration and before being press fit into the first bore of the collet contact.

FIG. 4A is a view showing a substantially flat stamped piece 49 comprising a band member 45 from which the contact fingers 42A–D extend. The flat piece 49 is rolled to form the cylindrical configuration of the female socket 40 as depicted in FIG. 2. The length of the band member 45 must be long enough so that when it is rolled into the generally cylindrical shape of the female socket as shown in FIG. 4B, the outer diameter of the rolled band 45 is slightly greater than the inner diameter of the first bore 40A of the collet contact 30. This is necessary to facilitate the press fit of the rolled first female socket 40 into the first bore 40A of the collet contact 30.

Chamfer sections 44A and 44B are cut out on the edge of each of the contact fingers 42A–D so that when the stamped piece is rolled, the outer profile of each contact finger is generally circular. The stamped piece 49 is made from an electrically conductive, spring tempered material, an example of which is beryllium copper.

FIG. 4B is a view of the band member 45 and contact fingers 42A–D of the first female socket 40 of FIG. 2 after rolling the substantially flat stamped piece 49 of FIG. 4A to form a generally cylindrical configuration and before being press fit into the first bore 40A of the collet contact 30. The contact fingers 42A–D are bent inwardly along the length of the fingers such that the cylindrical shape roughly resembles an hour glass and forms a center socket column 46 for receiving a center conductor wire. The inner diameter of the socket column 46 varies along the length of the contact fingers 42A–D, providing a waist 46A at the point where the distance between the converging contact fingers 42A–D is the smallest. The inner diameter of the waist 46A of the socket column 46 is also less than the outer diameter of the smallest center conductor wire to be received in order to facilitate electrical contact upon insertion of the wire into the socket 40.

The generally cylindrical, hourglass-like shape of the first female socket 40 provides two points of contact a and b with the collet contact 30 after the socket is press fit within the first bore 40A. The dual contact points a and b facilitate electronic communication between the collet contact and the center conductor wire. The overall resistance of the collet contact is also reduced by having each finger 42A–D contact the inner surface of the bore 40A at points a and b. The support provided by the dual contact points also insures more reliable retention of the mating contact with the incoming conductor wire.

Figure 5A:
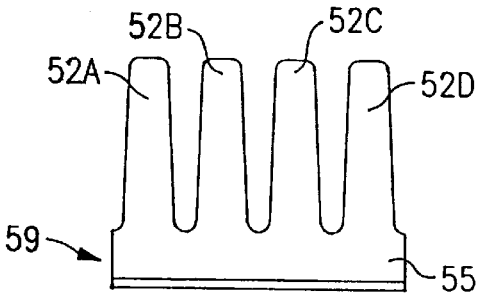
FIG. 5A is a view showing the stamped band member and contact fingers before rolling to form the cylindrical configuration of the second female socket as depicted in FIG. 2.
Figure 5B:
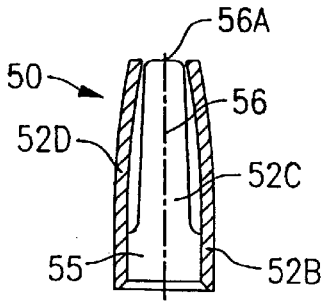
FIG. 5B is a view of the stamped band member and contact fingers of the second female socket after rolling to form a generally cylindrical configuration and before being press fit into the second bore of the collet contact.

FIG. 5A is a view showing a substantially flat stamped piece 59 comprising a band member 55 from which the contact fingers 52A–D extend. The flat piece 59 is rolled to form the cylindrical configuration of the female socket 50 as depicted in FIG. 2. The length of the band member 55 must be long enough so that when it is rolled into the generally cylindrical shape of the female socket as shown in FIG. 5B, the outer diameter of the rolled band 55 is slightly greater than the inner diameter of the second bore 50A of the collet contact 30. This is necessary to facilitate the press fit of the rolled second female socket 50 into the second bore SOA of the collet contact 30.

FIG. 5B is a view of the band member 55 and contact fingers 52A–D of the second female socket 50 of FIG. 2 after rolling the substantially flat stamped piece 59 of FIG. 5A to form a generally cylindrical configuration and before being press fit into the second bore 50A of the collet contact 30. The contact fingers 52A–D are bent inwardly along the length of the fingers forming a tapered center socket column 56 for receiving a presoldered conductor wire. The inner diameter of the tapered socket column 56 varies along the length of the contact fingers 52A–D, providing a point 56A where the distance between the converging contact fingers 52A–D is the smallest. The inner diameter of the point 56A of the socket column 56 is also less than the outer diameter of the smallest presoldered conductor wire to be received in order to facilitate electrical contact upon insertion of the presoldered conductor wire into the socket 50.

Figure 6A:
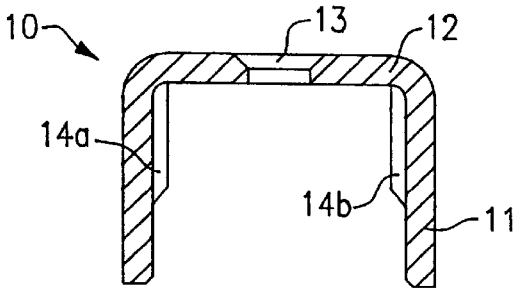
FIG. 6A is a cross sectional view of the front insulator of FIG. 2.
Figure 6B:
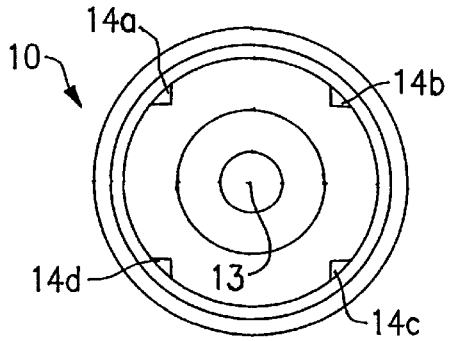
FIG. 6B is a plan view of the open end of the front insulator of FIG. 2.

FIG. 6A is a cross sectional view of the front insulator 10 of FIG. 2. The front insulator 10 includes a generally cylindrical sidewall 11 and an end wall 12 substantially enclosing one end of the front insulator. The end wall 12 includes a guide hole 13 through which the center conductor of a cable may be introduced into the collet assembly. The front insulator 10 also includes a plurality of inner ridges 14*a–d* extending longitudinally along the inner surface of sidewall 11. FIG. 6B is a plan view of the open end of the front insulator 10 of FIG. 2, showing the plurality of ridges 14*a–d* located on the inner surface of sidewall 11. The guide hole 13 is centered on the end wall 12.

Figure 7A:
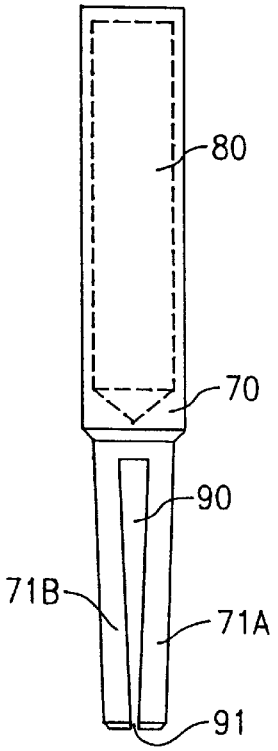
FIG. 7A is a plan view of a collet contact in accordance with another embodiment of the present invention.
Figure 7B:
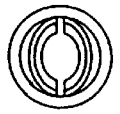
FIG. 7B is an end view of an extended collet contact forming a female socket in accordance with another embodiment of the present invention.

FIG. 7A is a plan view and FIG. 7B is a bottom view of a collet contact 70 in accordance with another embodiment of the present invention. The collet contact 70 is substantially cylindrical in shape. A first bore 80 is provided for receiving a first female socket, such as the first female socket 40 shown in FIG. 2. A second female socket 90 is provided by the elongated contact fingers 71A–B which are an extension of the collet contact 70, and which are bent to taper along the length of the contact fingers. The diameter of the female socket 90 decreases along the length of the tapered contact fingers to a neck point 91. The inner diameter of the neck point 91 is less than the outer diameter of the smallest presoldered conductor wire to be received in order to facilitate electrical contact upon reception of the presoldered conductor wire into the socket 90. The collet contact 70 of this embodiment of the present invention is made of an electrically conductive material, an example of which includes brass.

Figure 8:
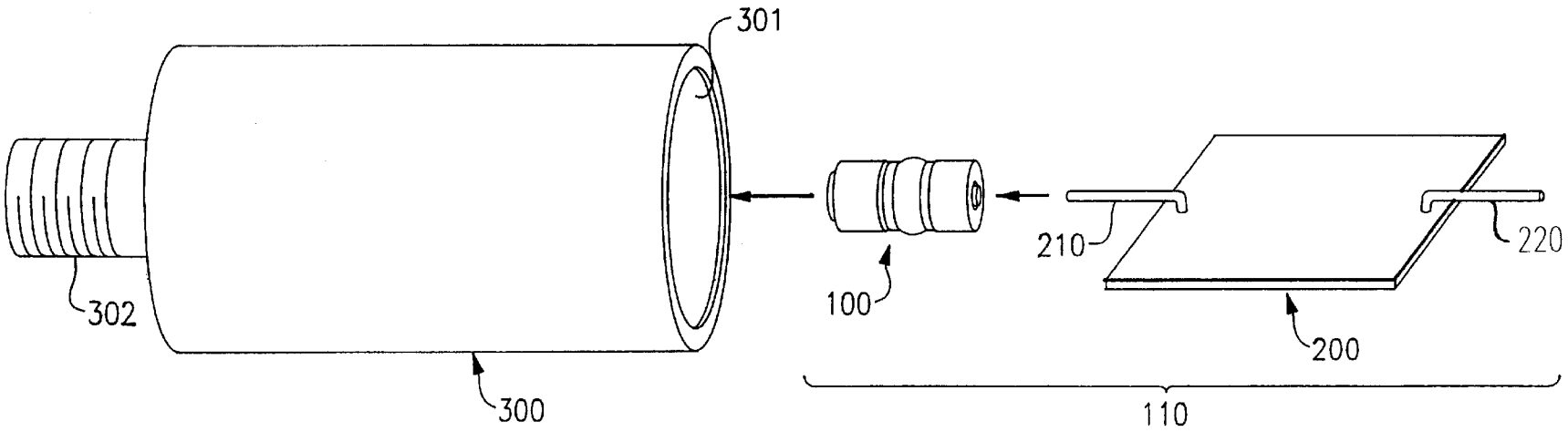
FIG. 8 is a partial exploded view showing the assembly of the circuit board and the collet assembly of the present invention within a housing for an electronic device.

FIG. 8 is a partial exploded view showing the assembly of a circuit board 200 and the collet assembly 100 of the present invention within a housing 300 for an electronic device. The conductor wires 210 and 220 are contemporaneously wave soldered to the circuit board unit 200 as described above. The first presoldered conductor wire 210 is inserted into the collet assembly 100 by mechanical insertion into the second female socket 50 shown in FIG. 2. The collet assembly-circuit board unit 110 is then inserted into the housing 300 such that the collet assembly 100 is positioned within the female connector bore 302 and the circuit board is positioned within the center bore 301.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. An electronic device of the type including a threaded female connector adapted to mate with a cable connector, comprising:

a housing;

a female connector extending from said housing;

a circuit board positioned within said housing and having a first presoldered conductor wire extending therefrom toward said female connector; and a collet assembly positioned within a bore of said female connector, comprising a generally cylindrical insulating body, and having a first end and an opposed second end, an electrically conductive collet contact passing through said insulating body and having a first end proximate said first end of said insulating body and a second end proximate said second end of said insulating body, said first end of said collet contact having a first gripping member for gripping an external conductor wire introduced into said female connector bore, said second end of said collet contact having a second gripping member for gripping said first presoldered conductor wire;

wherein said first presoldered conductor wire is supported only by said circuit board and said second gripping member.

2. The electronic device of claim 1, wherein said first gripping member comprises a first female socket secured within a bore formed within said first end of said collet contact.

3. The electronic device of claim 2, wherein said first female socket of said collet assembly comprises a band member and contact fingers extending from said band member in a longitudinal direction of said collet contact.

4. The electronic device of claim 1, wherein said second gripping member comprises a second female socket secured within a bore formed within said second end of said collet contact.

5. The electronic device of claim 4, wherein said second female socket of said collet assembly comprises a band member and contact fingers extending from said band member in a longitudinal direction of said collet contact.

6. The electronic device of claim 1, wherein said first gripping member is defined by an axially split and radially compressed bore formed within said first end of said collet contact.

7. The electronic device of claim 1, wherein said second gripping member is defined by an axially split and radially compressed bore formed within said second end of said collet contact.

8. The electronic device of claim 1, wherein said insulating body of said collet assembly comprises a front insulator having, an inner surface and an outer surface, and a rear insulator having an inner surface and an outer surface.

9. The electronic device of claim 8, wherein said rear insulator of said collet assembly further comprises a first section having a first diameter and a second section having a second diameter, and wherein a portion of said first section of said rear insulator extends within said front insulator.

10. The electronic device of claim 9, wherein said collet assembly further comprises a seal positioned between said first and said second sections of said rear insulator.

11. The electronic device of claim 9, wherein said rear insulator of said collet assembly further comprises a third section having a third diameter, positioned between said first section and said second section of said rear insulator.

12. The electronic device of claim 11, wherein said collet assembly further comprises a seal seated on the outer surface of said third section of said rear insulator.

13. The electronic device of claim 8, wherein said front insulator comprises a cylindrical sidewall having an inner surface and an outer surface, and an end wall substantially enclosing one end of said front insulator, wherein said portion of said first section of said rear insulator is surrounded by said sidewall of said front insulator.

14. The electronic device of claim 13, wherein said front insulator further comprises a plurality of longitudinally extending ridges on an inner surface of said sidewall, said ridges contacting said portion of said first section of said rear insulator.

15. An electronic device of the type including a threaded female connector adapted to mate with a cable connector, comprising:

a housing;

a female connector extending from said housing;

a circuit board positioned within said housing and having a first presoldered conductor wire extending therefrom toward said female connector; and a collet assembly positioned within a bore of said female connector, comprising a generally cylindrical insulating body, and having a first end positioned entirely within said bore of said female connector and an opposed second end, an electrically conductive collet contact passing through said insulating body and having a first end proximate said first end of said insulating body and a second end proximate said second end of said insulating body, said first end of said collet contact having a first gripping member for gripping an external conductor wire introduced into said female connector bore, said second end of said collet contact having said second gripping member for gripping said first presoldered conductor wire.

* * * * *